US011264185B2

(12) United States Patent
Yang

(10) Patent No.: US 11,264,185 B2
(45) Date of Patent: Mar. 1, 2022

(54) BUTTON SWITCH AND RESTORATION ASSEMBLY THEREOF

(71) Applicant: DARFON ELECTRONICS CORP., Taoyuan (TW)

(72) Inventor: Sheng-Yun Yang, Taoyuan (TW)

(73) Assignee: DARFON ELECTRONICS CORP., Taoyuan (TW)

( * ) Notice: Subject to any disclaimer, the term of this patent is extended or adjusted under 35 U.S.C. 154(b) by 0 days.

(21) Appl. No.: 17/089,747

(22) Filed: Nov. 5, 2020

(65) Prior Publication Data

US 2022/0013309 A1 Jan. 13, 2022

(30) Foreign Application Priority Data

Jul. 9, 2020 (TW) ..... 109123234

(51) Int. Cl.
*H01H 13/14* (2006.01)
*H01H 13/30* (2006.01)
*H01H 13/10* (2006.01)

(52) U.S. Cl.
CPC ..... *H01H 13/14* (2013.01); *H01H 13/10* (2013.01); *H01H 13/30* (2013.01)

(58) Field of Classification Search
CPC ..... H01H 3/125; H01H 13/705; H01H 13/14; H01H 13/70; H01H 13/704; H01H 13/7065; H01H 13/7006; H01H 13/7057; H01H 13/78; H01H 13/79; H01H 13/52; H01H 13/703; H01H 13/507
See application file for complete search history.

(56) References Cited

U.S. PATENT DOCUMENTS 5,938,009 A * 8/1999 Huang ..... H01H 13/705 200/517
11,056,293 B1 * 7/2021 Chen ..... H01H 13/7073
2013/0140162 A1 * 6/2013 Lu ..... H01H 13/7065 200/344

FOREIGN PATENT DOCUMENTS

| | | | |
|---|---|---|---|
| CN | 203553003 | U | 4/2014 |
| CN | 106024474 | A | 10/2016 |
| CN | 206907691 | U | 1/2018 |
| CN | 106024474 | B | 7/2018 |
| CN | 106356230 | B | 7/2018 |
| CN | 207977257 | U | 10/2018 |
| CN | 208478204 | U | 2/2019 |
| CN | 209343971 | U | 9/2019 |
| TW | 201729229 | A | 8/2017 |
| TW | 201926384 | A | 7/2019 |

* cited by examiner

*Primary Examiner* — Ahmed M Saeed
(74) *Attorney, Agent, or Firm* — Winston Hsu

(57) ABSTRACT

A restoration assembly of a button switch includes first and second sleeves, and a spring disposed between the two sleeves. A first outer diameter of the first sleeve is less than a second inner diameter of the second sleeve to make the second sleeve movably jacket outside the first sleeve. The jacketed first and second sleeves are disposed between a key cap and a base of the button switch. The spring has a first end portion, a second end portion and a middle section. A middle outer diameter of the middle section of the spring is larger than a first inner diameter of the first sleeve. During the spring being compressed along with the key cap being pressed downward, the middle section is squeezed to shrink and slide into the first sleeve through an end edge of the first sleeve, thereby producing a tactile feedback and/or a first sound.

18 Claims, 10 Drawing Sheets

BUTTON SWITCH AND RESTORATION ASSEMBLY THEREOF

BACKGROUND OF THE INVENTION

1. Field of the Invention

The present invention relates to a button switch and a restoration assembly thereof, and more specifically, to a button switch providing a tactile feedback via interference/disengagement between a spring of a restoration assembly and a sleeve.

2. Description of the Prior Art

A keyboard, which is the most common input device, could be found in variety of electronic apparatuses for users to input characters, symbols, numerals and so on. Furthermore, from consumer electronic products to industrial machine tools, they are all equipped with a keyboard for performing input operations.

In practical application, there are various kinds of keyswitches for providing different tactile feedbacks. For example, a gaming keyboard would indicates that it has red, brown or black keyswitches installed thereon on its packing box to remind the user of what kind of tactile feedback (e.g. high or low triggering position, long or short travel distance, tactile or linear feedback, clicky or non-clicky tactile feedback, etc.) the gaming keyboard could provide.

In the clicky tactile feedback design, it usually involves additionally disposing a flexible acoustic member in the button switch to partially interfere with a shaft of the button switch. Accordingly, when a user presses the button switch, the shaft presses the flexible acoustic member to deform, and then the flexible acoustic member returns to its original position to generate a tactile feedback or further collides with an internal member of the button switch to make sound. However, the aforesaid design usually causes an additional component cost and a time-consuming and strenuous keyswitch manufacturing process and occupies much internal space of the keyswitch.

SUMMARY OF THE INVENTION

The present invention provides a button switch including a key cap, a base, and a restoration assembly. The base is disposed opposite to the key cap. The restoration assembly is disposed between the key cap and the base and includes a first sleeve, a second sleeve, and a spring. The first sleeve has a first inner diameter and a first outer diameter. The second sleeve has a second outer diameter larger than the first outer diameter of the first sleeve to make the second sleeve movably jacket outside the first sleeve. The jacketed first and second sleeves are disposed between the key cap and the base. The spring is disposed between the first sleeve and the second sleeve. The spring has a first end portion, a second end portion and a middle section. A middle outer diameter of the middle section is larger than the first inner diameter of the first sleeve. When the key cap is located at a non-pressed position, the first end portion is disposed through the first sleeve, and the second end portion and the middle section are disposed through the second sleeve. During the spring being compressed along with the key cap being pressed downward, the middle section is squeezed to shrink and slide into the first sleeve through an end edge of the first sleeve, thereby producing a tactile feedback and/or a first sound. When the spring is released from a pressed position along with the key cap, the spring extends to move the middle section from the first sleeve back into the second sleeve.

The present invention further provides a restoration assembly for returning the button switch after the button switch is pressed. The restoration assembly includes a first sleeve, a second sleeve, and a spring. The first sleeve has a first inner diameter and a first outer diameter. The second sleeve has a second outer diameter larger than the first outer diameter of the first sleeve to make the second sleeve movably jacket outside the first sleeve. The spring is disposed between the first sleeve and the second sleeve. The spring has a first end portion, a second end portion and a middle section. A middle outer diameter of the middle section is larger than the first inner diameter of the first sleeve. When the first sleeve and the second sleeve are in a stretched state, the first end portion is disposed through the first sleeve, and the second end portion and the middle section are disposed through the second sleeve. When the first sleeve and the second sleeve are in a compressed state, the middle section is squeezed to shrink and slide into the first sleeve through an end edge of the first sleeve, thereby producing a tactile feedback and/or a sound. When the first sleeve and the second sleeve are released from the compressed state, the spring extends to move the middle section from the first sleeve back into the second sleeve.

These and other objectives of the present invention will no doubt become obvious to those of ordinary skill in the art after reading the following detailed description of the preferred embodiment that is illustrated in the various figures and drawings.

DETAILED DESCRIPTION

Figure 1A:
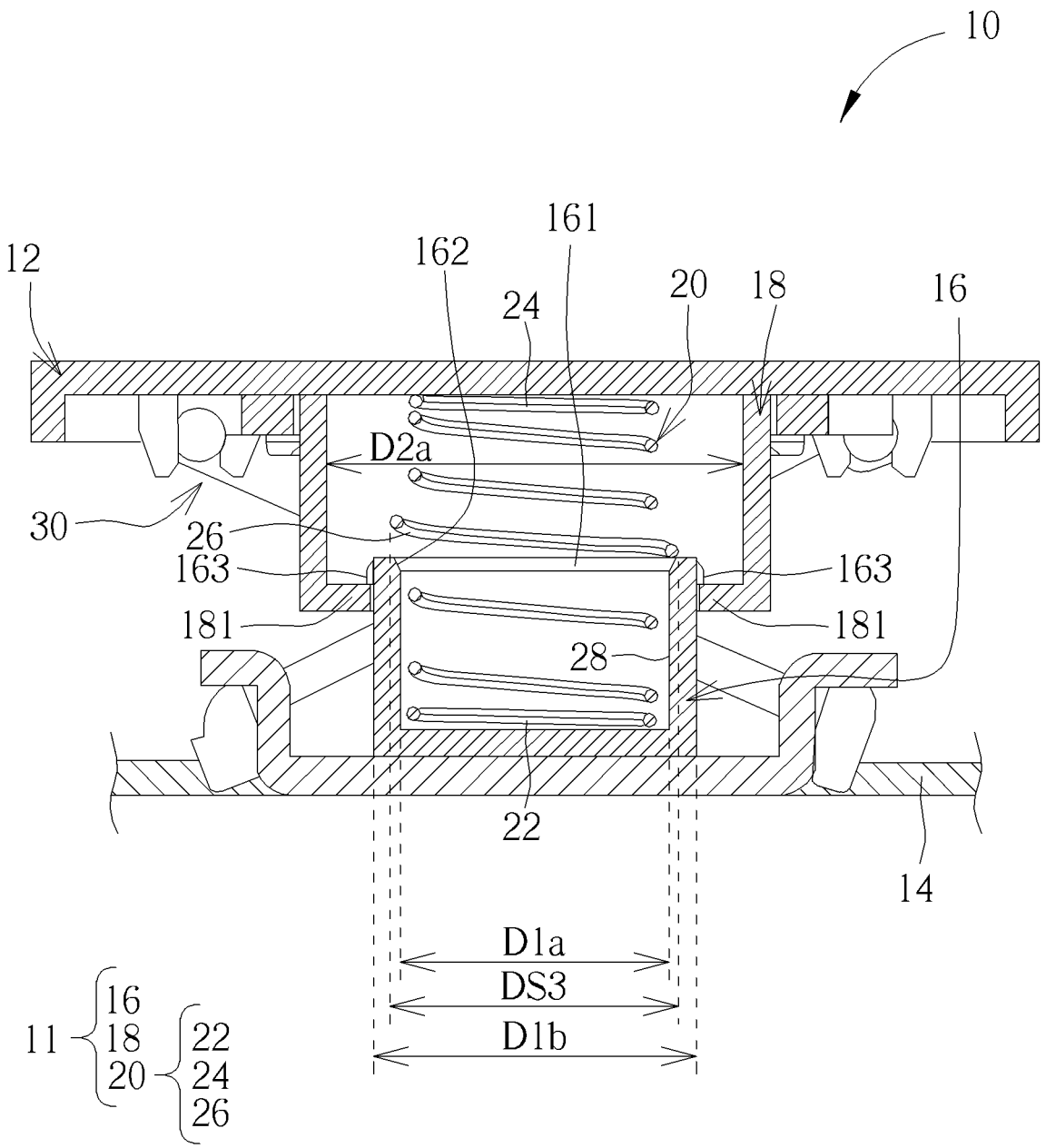
FIG. 1A is a cross-sectional diagram of a button switch according to an embodiment of the present invention.
Figure 2A:
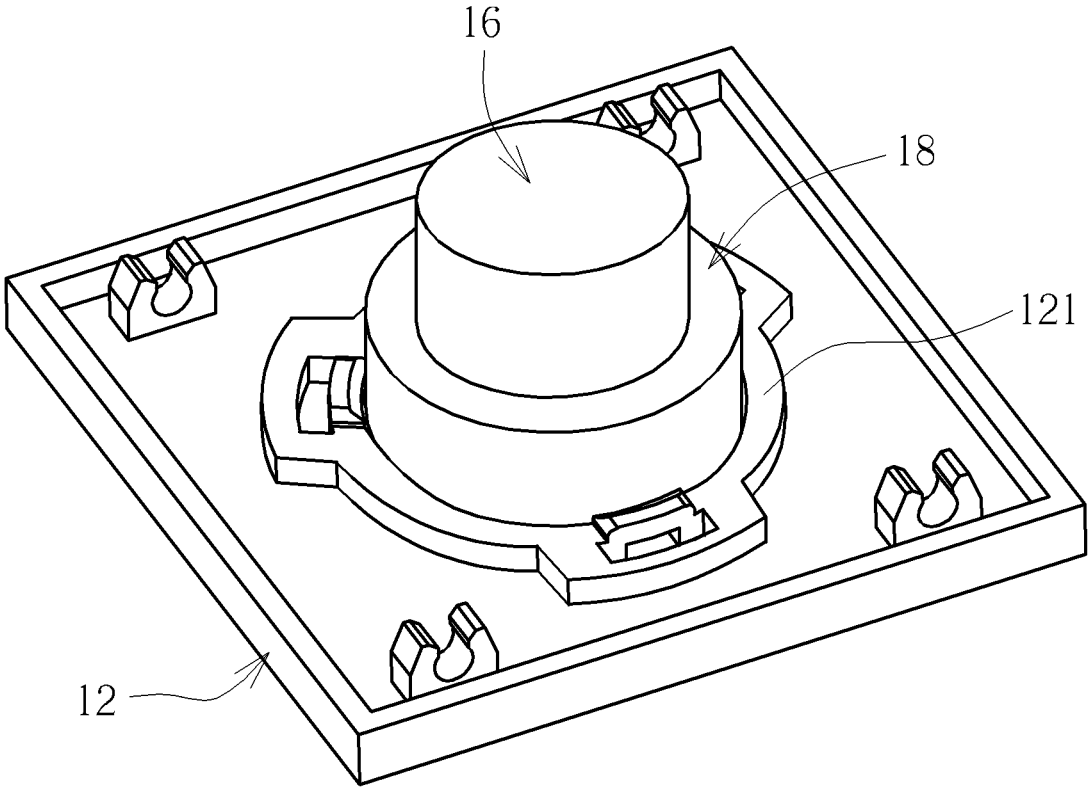
FIG. 2A is an assembly diagram of a key cap, a first sleeve and a second sleeve in FIG. 1A.

Please refer to FIG. 1A and FIG. 2A. FIG. 1A is a cross-sectional diagram of a button switch 10 according to an embodiment of the present invention. FIG. 2A is an assembly diagram of a key cap 12, a first sleeve 16 and a second sleeve 18 in FIG. 1A. As shown in FIG. 1A and FIG. 2A, in this embodiment, the button switch 10 includes a restoration assembly 11, the key cap 12 and a base 14. A plurality of button switches 10 can form a keyboard cooperatively and is applied to an independent keyboard or a portable electronic device (e.g. a built-in keyboard module of a notebook or a foldable leather keyboard capable of connecting to a tablet computer) for a user to press, so as to perform input functions. The key cap 12 extending horizontally is disposed opposite to the base 14, and the restoration assembly 11 is disposed between the key cap 12 and the base 14 for providing a returning force to make the key cap 12 movable upward and downward between a non-pressed position (e.g. the key cap 12 moving to the highest position, meaning that the restoration assembly 11 and a spring 20 are in a stretched state) and the pressed position (e.g. the key cap 12 moving to a position lower than the highest position, meaning that the restoration assembly 11 and the spring 20 are in a compressed state).

To be more specific, the restoration assembly 11 includes a first sleeve 16 in a cylindrical shape, a second sleeve 18, and the spring 20. Closed ends of the first sleeve 16 and the second sleeve 18 are spaced away from a position where the first sleeve 16 is jacketed by the second sleeve 18, and open ends of the first sleeve 16 and the second sleeve 18 are located at the position where the first sleeve 16 is jacketed by the second sleeve 18, such that the spring 20 can be disposed through the first sleeve 16 and the second sleeve 18. The first sleeve 16 has a first inner diameter D1*a* and a first outer diameter D1*b*. The second sleeve 18 has a second inner diameter D2*a*. The second inner diameter D2*a* is larger than the first outer diameter D1*b* of the first sleeve 16, so as to make the second sleeve 18 capable of movably jacketing outside the first sleeve 16.

In FIGS. 1A and 2A, the second sleeve 18 is directly connected to the key cap 12, and the first sleeve 16 is jacketed by the second sleeve 18 to make a terminal end of the first sleeve 16 abut against or be close to the base 14. The first sleeve 16 could be connected to the base 14 or could only abut against the base 14 without connection. In other words, if the first sleeve 16 is not directly connected to the base 14, the restoration assembly 11 can be detached from the base 14 together with key cap 12 when the key cap 12 is detached (as show in FIG. 2A).

The second sleeve 18 is connected to the key cap 12, for example, by directly extending from a bottom surface of the key cap 12 or by engaging the second sleeve 18 with the key cap 12 through an engaging structure 121. If necessary, the second sleeve 18 could be detachably connected to the key cap 12, so that the user can replace the restoration assembly 11 or the spring 20 conveniently to change the tactile feedback and/or sound produced by the restoration assembly 11. An end of the first sleeve 16 jacketed by the second sleeve 18 has a limiting portion 163 surrounding an outer wall of the first sleeve 16. An end of the second sleeve 18 jacketing the first sleeve 16 has a protruding edge 181 formed along an inner wall of the first sleeve 16 correspondingly for interfering with the limiting portion 163, so as to prevent the first sleeve 16 from coming off the second sleeve 18 when the spring 20 extends. In such a manner, the first sleeve 16 can form a telescopic sleeve structure cooperatively with the second sleeve 18 and the spring 20 for abutting the spring 20 against the key cap 12 and the base 14 indirectly to provide a returning force. During the spring 20 being compressed, stretched, shrunk, or expanded correspondingly along with upward and downward movement of the key cap 12, the spring 20 is located in a containing space cooperatively formed by the first sleeve 16 and the second sleeve 18 for protection of the spring 20, so as to extend the service life of the spring 20.

Figure 2B:
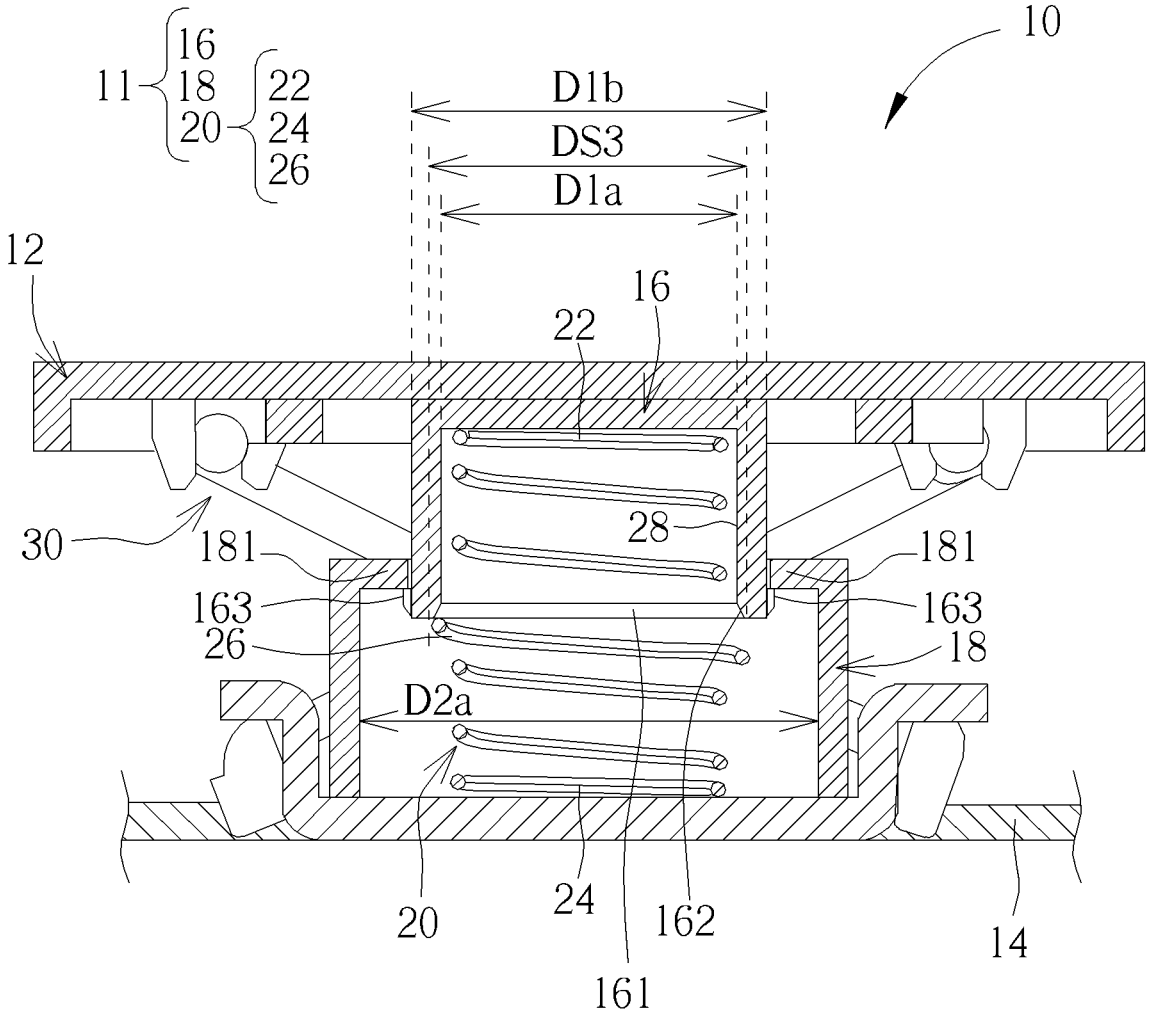
FIG. 2B is a cross-sectional diagram of a button switch according to another embodiment of the present invention.

In another embodiment, as shown in FIG. 2B, the present invention could adopt the design that the second sleeve 18 is fixedly disposed on the base 14 and the first sleeve 16 is close to or abuts against the bottom surface of the key cap 12, which is opposite to the aforesaid design as shown in FIG. 1A, for generating the same effect. The related description for this design as shown in FIG. 2B could be reasoned by analogy according to the following description and omitted herein.

Figure 1B:
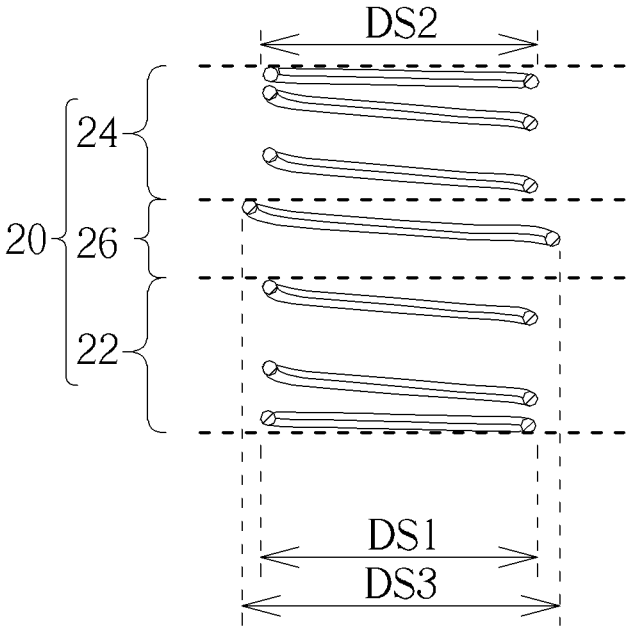
FIG. 1B is a cross-sectional diagram of a spring in FIG. 1A.

As shown in FIGS. 1A and 1B, in this embodiment, the spring 20 has a first end portion 22, a second end portion 24 and a middle section 26. The middle section 26 is located between the first end portion 22 and the second end portion 24. In FIG. 1A, the key cap 12 is located at the non-pressed position, which means the restoration assembly 11 and the spring 20 are in the stretched state. At this time, the first end portion 22 is disposed through the first sleeve 16, and the second end portion 24 and the middle section 26 are disposed through the second sleeve 18. In FIGS. 1A/2B/3A/3B/4, the second sleeve 18 has two open ends and the second end portion 24 of the spring 20 does not abut against a terminal end of the second sleeve 18, but the present invention is not limited thereto. That is, in another embodiment, the terminal end of the second sleeve 18 could be closed and have an inner wall, and the second end portion 24 of the spring 20 could directly abut against the inner wall of the terminal end of the second sleeve 18.

As shown in FIGS. 1A and 1B, in this embodiment, a first outer diameter DS1 of the first end portion 22 of the spring 20 and a second outer diameter DS2 of the second end portion 24 of the spring 20 are both less than a middle outer diameter DS3 of the middle section 26. The first outer diameter DS1 and the second outer diameter DS2 of the spring 20 are both less than the first inner diameter D1*a* of the first sleeve 16. The middle outer diameter DS3 is larger than the first inner diameter D1*a* of the first sleeve 16. In practical application, the middle section 26 of the spring 20 is a protruding portion expanding outward from one section of the spiral structure of the spring 20. A spiral angle of the middle section 26 can be up to 360 along the spiral structure, so as to ensure that the middle section 26 can interfere with the first sleeve 16 surely. In another embodiment, the spiral angle of the middle section 26 could be less than 360 to decrease the structural interference range of the middle section 26 and the first sleeve 16, or be larger than 360 to increase the structural interference range of the middle section 26 and the first sleeve 16. However, in another embodiment, the spiral angle of the middle section 26 can be up to 1080° to make the middle section 26 form a multi-circle spiral structure, and an outer diameter of each circle of the middle section 26 could be different from each other for producing different interference strengths and a special tactile feedback during the interference process.

Furthermore, the button switch 10 could further include a lifting mechanism 30. The lifting mechanism 30 is movably connected to the key cap 12 and the base 14. In this embodiment, the lifting mechanism 30 could preferably adopt a scissor support design (but not limited thereto, meaning that the lifting mechanism 30 could adopt other support design, such as a V-shaped support design or an inverted V-shaped support design). Accordingly, no matter which position of the key cap 12 is pressed by the user, the key cap 12 can move vertically relative to the base 14 without deflection via the lifting mechanism 30. In another embodiment, the lifting mechanism 30 could be omitted, meaning that the key cap 12 can move vertically via the jacketing design of the first sleeve 16 and the second sleeve 18. If necessary, opposite surfaces of the first sleeve 16 and the second sleeve 18 (i.e. an outer surface of the first sleeve 16 and an inner surface of the second sleeve 18) could have a concave slot and a convex rail extending from up to down, so that the concave slot and the convex rail can be engaged with each other for improving motion stability of the key cap 12.

Figure 3A:
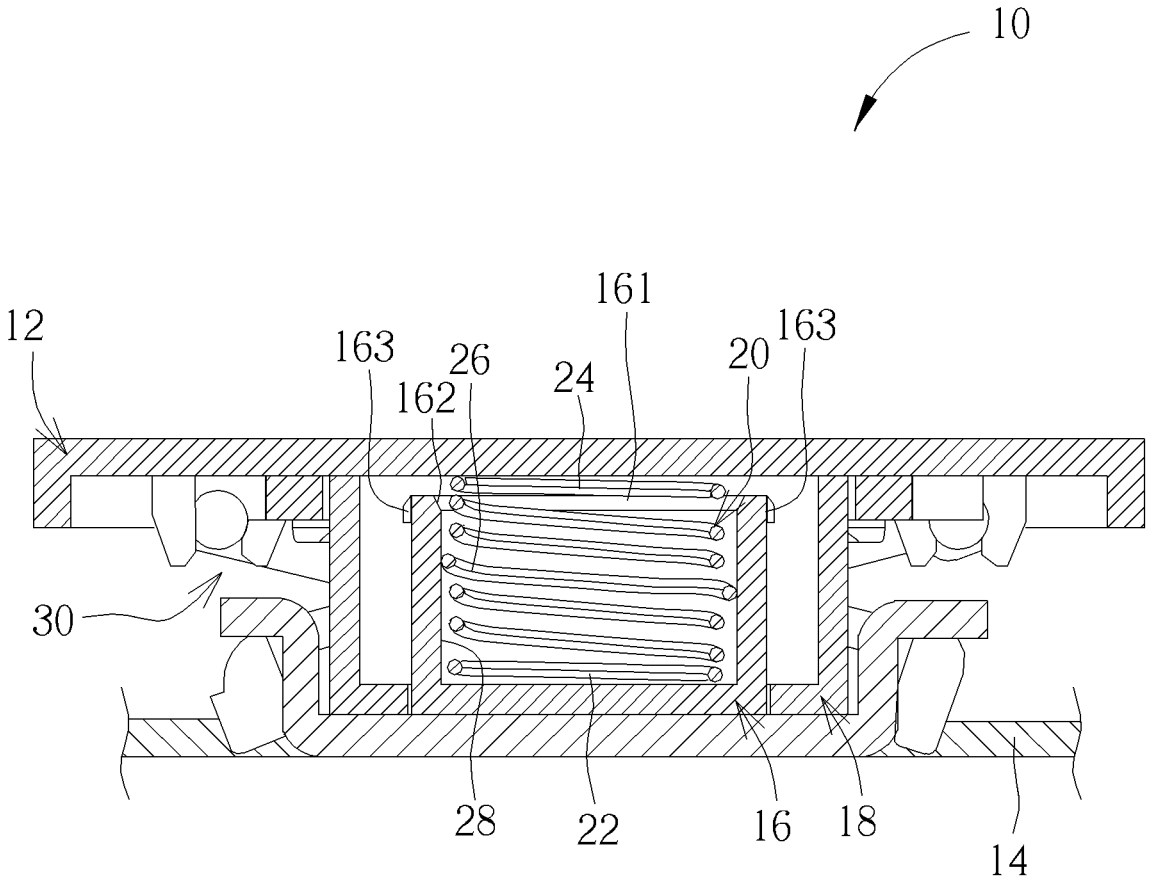
FIG. 3A is a cross-sectional diagram of the button switch in FIG. 1A when the second sleeve is pressed to a pressed position.

Via the aforesaid designs, when the user presses the key cap 12, the button switch 10 can generate a pressing resistance temporarily increased by interference between the spring 20 and the first sleeve 16 for producing a tactile feedback and/or a friction sound. To be more specific, please refer to FIG. 1A and FIG. 3A. FIG. 3A is a cross-sectional diagram of the button switch 10 in FIG. 1A when the second sleeve 18 is pressed to the pressed position. As shown in FIG. 1A and FIG. 3A, during the process of the second sleeve 18 being pressed from the non-pressed position as shown in FIG. 1A through the key cap 12 to compress the spring 20, the middle section 26 of the spring 20 interferes with the first sleeve 16 and is squeezed downward by the pressing force since the middle outer diameter DS3 of the middle section 26 is larger than the first inner diameter D1*a* of the first sleeve 16, so as to shrink the middle section 26 and reduce the middle outer diameter DS3. Accordingly, the middle section 26 can slide into the first sleeve 16 through an end edge 161 of the open end of the first sleeve 16 to produce a tactile feedback and/or a first sound, and then the second end portion 24 of the spring 20 can enter the first sleeve 16 completely or partially (as shown in FIG. 3A). The aforesaid tactile feedback is produced by releasing interference between the middle section 26 of the spring 20 and the first sleeve 16 after the middle section 26 of the spring 20 is shrunk and the middle outer diameter DS3 is reduced. That is, during the process of interference between the middle section 26 of the spring 20 and first sleeve 16 being released and the middle section 26 and the second end portion 24 sliding into the first sleeve 16 sequentially after the pressing resistance is temporarily increased, the tactile feedback that the pressing resistance is increased and then released can be produced accordingly. The first sound could be a friction sound made from friction between the middle section 26 and an inner wall 28 of the first sleeve 16. At the same time, the middle section 26 keeps contacting the inner wall 28 along with downward movement of the second sleeve 18 since the middle section 26 abuts against the inner wall 28 of the first sleeve 16 laterally, so that the user can sense a change of the tactile feedback during the process of the key cap 12 being pressed. In such a manner, the button switch 10 can provide the tactile feedback produced by interference between the middle section 26 of the spring 20 and first sleeve 16 being released longitudinally and the middle section 26 abutting against the inner wall 28 of the first sleeve 16 laterally. Moreover, the end edge 161 of the first sleeve 16 could have a slanted surface 162 in a funnel shape for guiding the middle section 26 of the spring 20 to slide into the first sleeve 16 smoothly.

On the other hand, when the key cap 12 is pressed to the pressed position as shown in FIG. 3A, meaning that the restoration assembly 11 and the spring 12 are about to return to the stretched state, the second sleeve 18 jackets outside the first sleeve 16 almost completely. When the spring 20 is released from the pressed position together with the key cap 12, the key cap 12 can move upward back to the non-pressed position as shown in FIG. 1A via a returning force provided by the spring 12, the second sleeve 18 can return to its original position along with movement of the keycap 12, and the middle section 26 of the spring 20 can move upward from the first sleeve 16 back into the second sleeve 18.

Figure 3B:
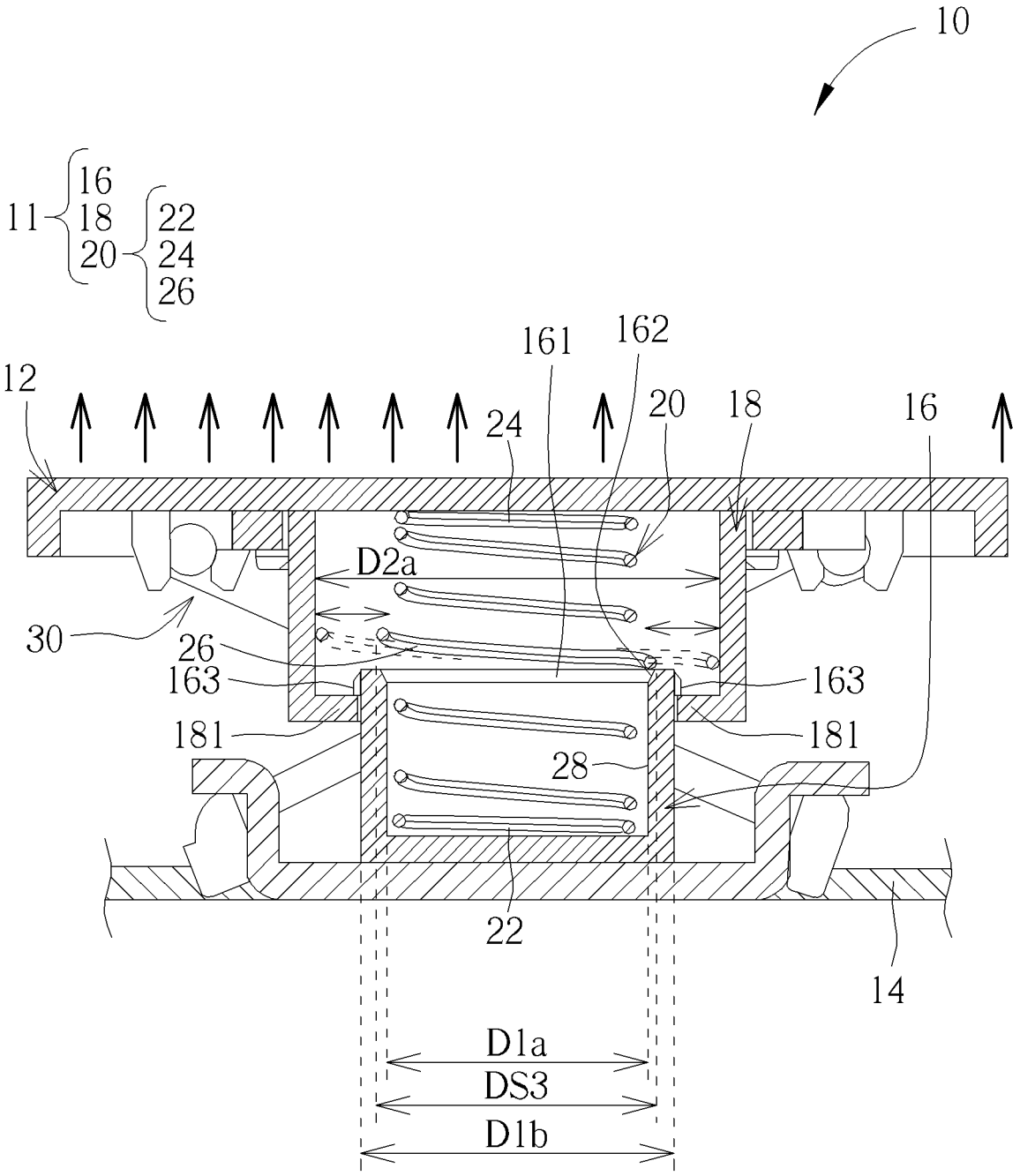
FIG. 3B is a cross-sectional diagram of a middle section of the spring in FIG. 3A being released to collide with an inner wall of the second sleeve.

During the aforesaid process, when the middle section 26 of the spring 20 moves upward along with the key cap 12 and the second sleeve 18 from a position as shown in FIG. 3A to a position where the middle section 26 is no longer constrained by the inner wall 28 of the first sleeve 16, the middle section 26 can elastically return to an undeformed state as shown in FIG. 1A to cause a change of the tactile feedback. As such, the button switch 10 can also provide a tactile feedback to the user during the process of the key cap 12 being released. Meanwhile, a second sound could be produced during the process of the key cap 12 being released. For example, during the process of the middle section 26 elastically returning to the undeformed state, the middle section 26 could expand outward to collide with the inner wall of the second sleeve 18 when the middle section 26 leaves the first sleeve 16, so as to make the second sound (as shown in FIG. 3B). That is, the button switch 10 not only produces a tactile feedback and/or sound during the process of the key cap 12 being pressed, but also produces another tactile feedback and/or sound during the process of the key cap 12 returning to its original position.

In another embodiment, the second outer diameter DS2 could be equal to or larger than the middle outer diameter DS3, which means the second outer diameter DS2 of at least one portion of the second end portion 24 could be larger than the first inner diameter D1*a* of the first sleeve 16. As such, the second end portion 24 of the spring 20 can interfere with the first sleeve 16 at the second half of downward movement of the key cap 12, so as to increase the pressing resistance of the key cap 12 for producing a different tactile feedback. Furthermore, since the second outer diameter DS2 of at least one portion of the second end portion 24 is larger than the first inner diameter D1*a* of the first sleeve 16, the middle section 26 and the second end portion 24 of the spring 20 can generate a larger expanding force when the key cap 12 moves upward from the pressed position. As such, during the upward sliding process of the middle section 26 and the second end portion 24, the middle section 26 and/or the second end portion 24 can elastically return to collide with the inner wall of the second sleeve 18 harder for making a bigger sound (the second sound).

As shown in FIGS. 1A and 3A, since the first outer diameter DS1 and the second outer diameter DS2 are less than the first inner diameter D1*a* of the first sleeve 16, the key cap 12 can have a smaller pressing resistance at the first half and the second half of downward movement of the key cap 12, and can have a larger pressing resistance during the middle section 26 interfering with the first sleeve 16, thereby producing an obvious tactile feedback.

The triggering design of the button switch 10 is not limited. For example, a pair of light transceivers could be disposed on the base 14, and a light blocking sheet could extend from the key cap 12 or the lifting mechanism 30. In such a manner, when the key cap 12 moves to the pressed position, which means the restoration assembly 11 and the spring 20 are in the compressed state, the light blocking sheet can block the light path between the light transceivers to change the intensity of light signals of the light transceivers for triggering the button switch 10. In another embodiment, a membrane could be disposed under the base 14 having a hole, and a triggering pillar could extend from the key cap 12 or the lifting mechanism 30. In such a manner, when the key cap 12 moves to the pressed position, which means the restoration assembly 11 and the spring 20 are in the compressed state, the triggering pillar can press a triggering pad on the membrane for triggering the button switch 10. In another embodiment, an optical distance sensor could be disposed on the base 14 for transmitting a triggering signal when determining that the keycap 12 or the lifting mechanism 30 has moved downward to a specific height (or over a distance).

Compared with the prior art additionally disposing a flexible acoustic member in the button switch to partially interfere with a shaft of the button switch, the present invention adopts the design that the spring having a larger middle outer diameter is utilized to interfere with the sleeve for providing a neat tactile feedback and/or sound. As such, the present invention can efficiently solve the problem that the prior art design causes an additional component cost and a time-consuming and strenuous keyswitch manufacturing process and occupies much internal space of the keyswitch. Thus, the present invention not only reduces the component and manufacturing costs of the button switch, but is also advantageous to the thinning design of the button switch.

Figure 4:
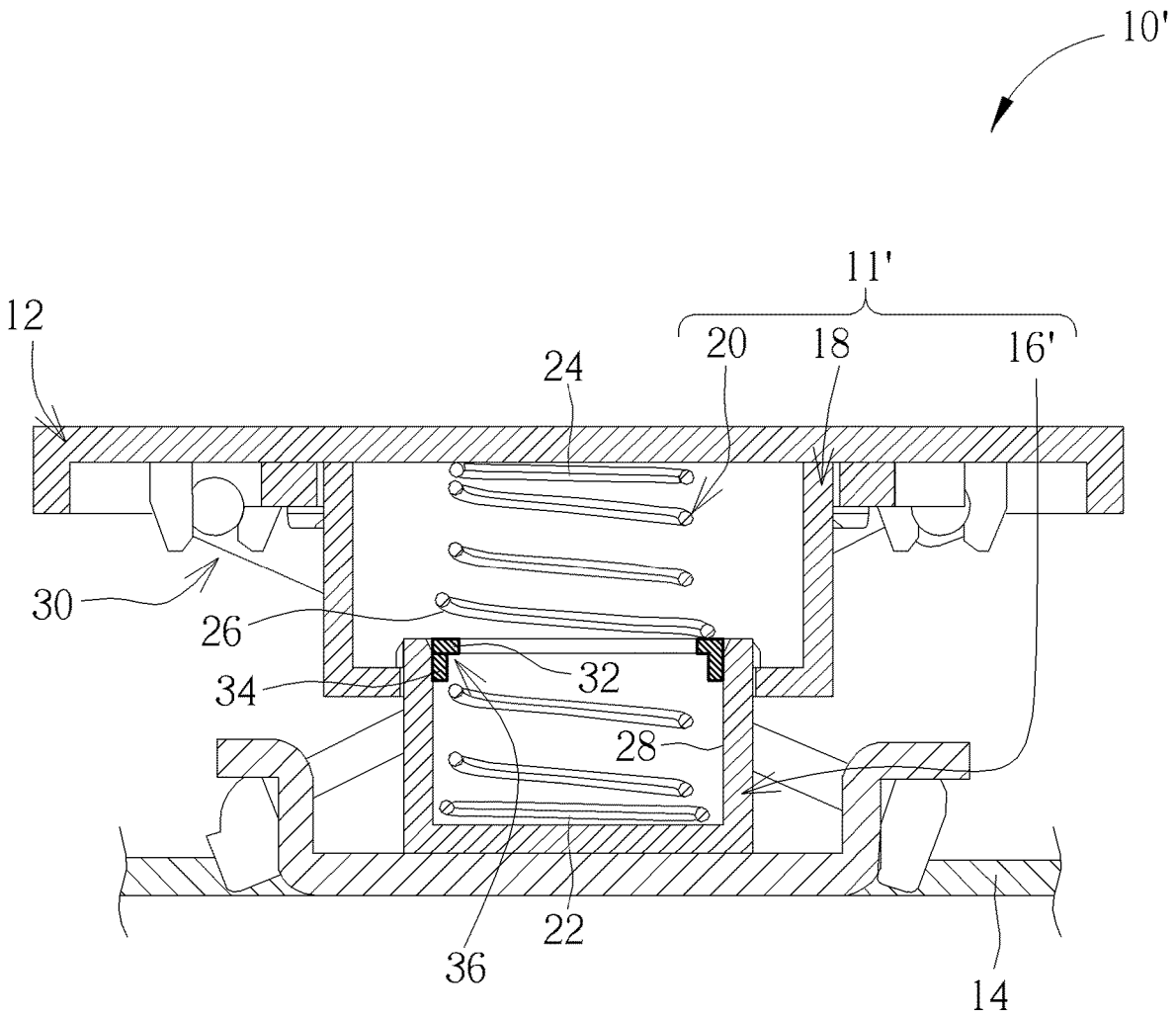
FIG. 4 is a cross-sectional diagram of a button switch according to another embodiment of the present invention.

The structural interference design of the spring and the sleeve is not limited to the aforesaid embodiments. For example, please refer to FIG. 4, which is a cross-sectional diagram of a button switch 10' according to another embodiment of the present invention. Components both mentioned in this embodiment and the aforesaid embodiments represent components with similar functions or structures, and the related description is omitted herein. As shown in FIG. 4, the button switch 10' includes a restoration assembly 11', the key cap 12, the base 14, a first sleeve 16', the second sleeve 18, the spring 20 and the lifting mechanism 30. An open end of first sleeve 16' has a first interference structure 32 and a second interference structure 34. An inner diameter of the first interference structure 32 is less than an inner diameter of the second interference structure 34, so that the first interference structure 32 and the second interference structure 34 can form a stepped structure 36 cooperatively with the inner wall 28. As such, the middle section 26 of the spring 20 can be shortly constrained and the middle outer diameter DS3 of the middle section 26 can be reduced during the process of the restoration assembly 11' and the spring 20 are in the compressed state.

Accordingly, during the process of the key cap 12 being pressed to compress the spring 20, the second sleeve 18 moves downward along with the key cap 12 to make the middle section 26 of the spring 20 interfered with the open end of the first sleeve 16' and constrained by the first interference structure 32. Subsequently, the middle section 26 is elastically deformed with downward movement of the key cap 12 to slide downward and then laterally abut against the first interference structure 32. With downward movement of the key cap 12 and the second sleeve 18, the middle section 26 keeps contacting the first interference structure 32 to produce friction/tactile feedbacks and/or friction sound.

Subsequently, when the middle section 26 moves downward together with the key cap 12 and the second sleeve 18 to cross the first interference structure 32, the middle section 26 is no longer constrained by the first interference structure 32 and elastically returns to expand the middle outer diameter DS3 for colliding with the second interference structure 34 to make a sound. As such, the button switch 10' can provide a clicky tactile feedback. At this time, the middle section 26 abuts against the second interference structure 34 laterally. When the middle section 26 keep moving downward together with the key cap 12 and the second sleeve 18 to cross the second interference structure 34, which means the middle section 26 slides downward to completely cross the stepped structure 36, the middle section 26 is not constrained by the second interference structure 34 and elastically returns to expand the middle outer diameter DS3 for colliding with the inner wall 28 of the first sleeve 16' to make a sound again.

In another embodiment, the stepped structure 36 can be only formed by the first sleeve 16' and the inner wall 28, and the related description for this embodiment (e.g. the sleeve jacketing design, the lifting mechanical design, the middle outer diameter design, etc.) could be reasoned by analogy according to the aforesaid embodiments and is omitted herein.

Figure 5:
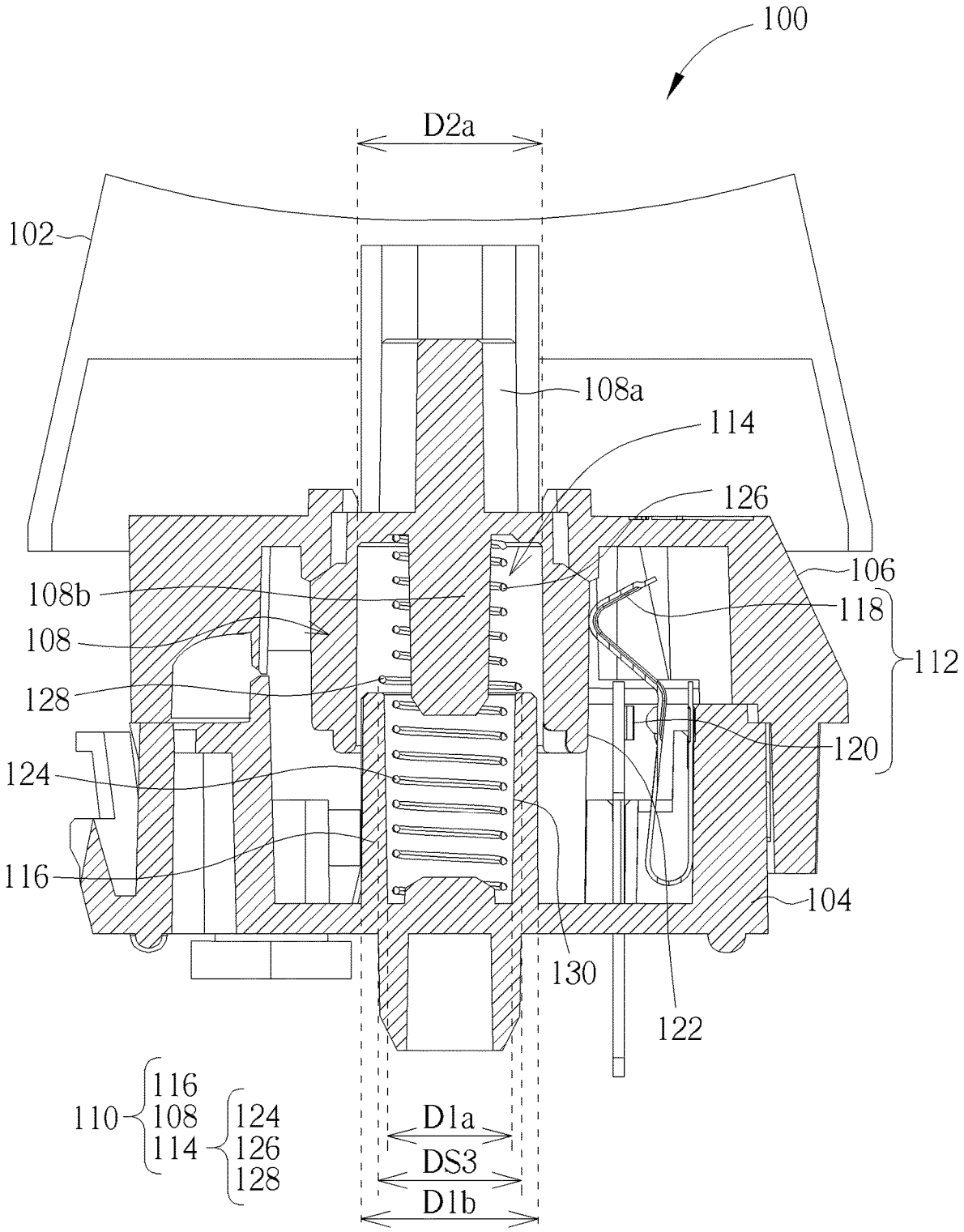
FIG. 5 is a cross-sectional diagram of a button switch according to another embodiment of the present invention.
Figure 6:
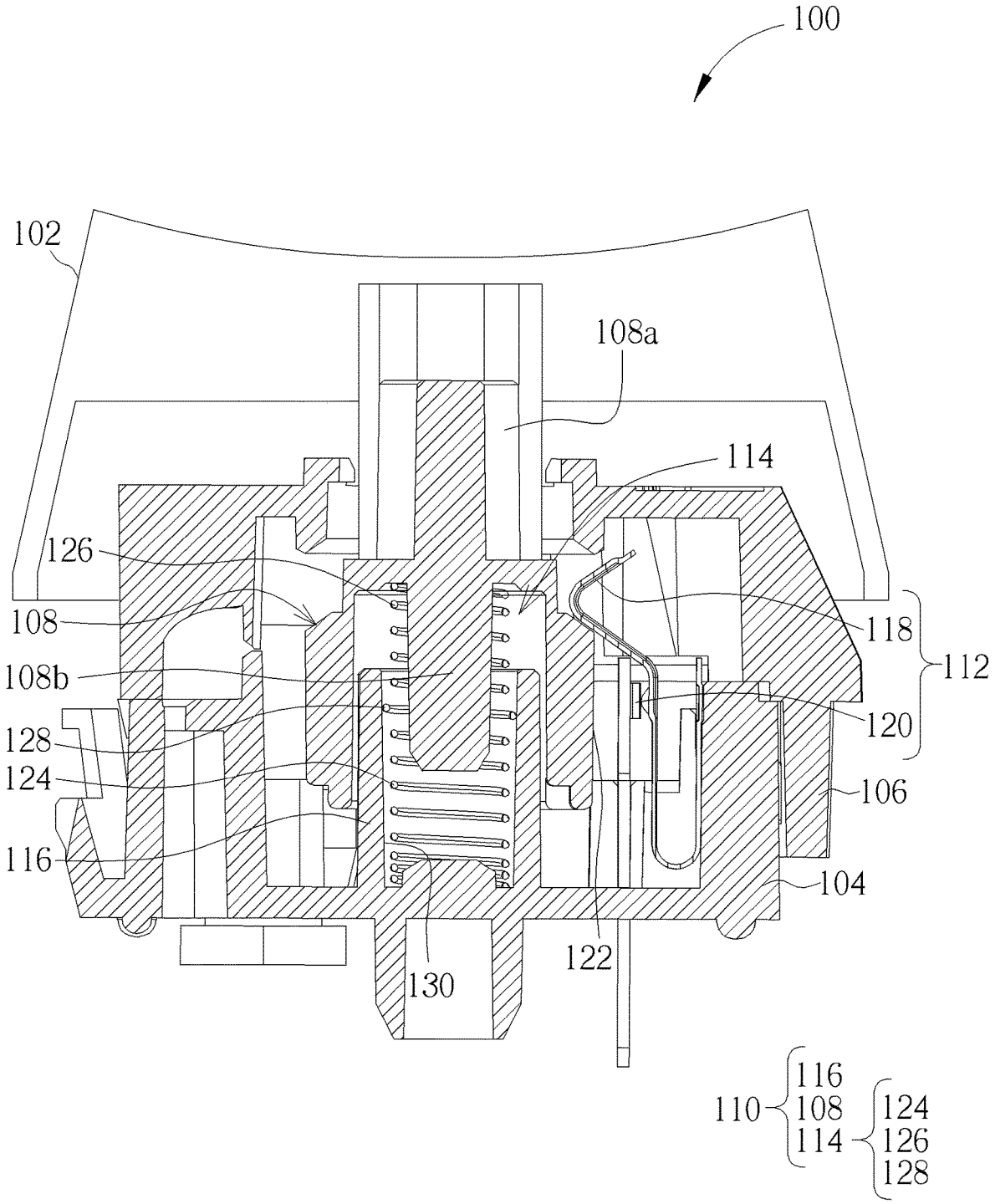
FIG. 6 is a cross-sectional diagram of the button switch in FIG. 5 when the key cap is pressed.

Furthermore, the present invention can be applied to a mechanical keyswitch. For example, please refer to FIG. 5 and FIG. 6. FIG. 5 is a cross-sectional diagram of a button switch 100 according to an embodiment of the present invention. FIG. 6 is a cross-sectional diagram of the button switch 100 in FIG. 5 when a key cap 102 is pressed. Components both mentioned in this embodiment and the aforesaid embodiments represent components with similar functions or structures, and the related description is omitted herein. As shown in FIGS. 5-6, the button switch 100 includes the key cap 102, a restoration assembly 110, a base 104, a cover 106, a second sleeve 108, a switch unit 112, and a spring 114. The base 104 has a first sleeve 116 protruding toward the key cap 102 and the cover 106. The first sleeve 116 has the first inner diameter D1*a* and the first outer diameter D1*b*. The cover 106 is disposed under the key cap 102 and assembled on the base 104, so that the cover 106 and the base 104 can cooperatively contain the switch unit 112 and the restoration assembly 110. The second sleeve 108 is movably disposed through the cover 106. The second sleeve 108 has a connection portion 108*a* extending upward to be connected to the key cap 102, and has a rod portion 108*b* extending downward to be inserted into a second end portion 126 of the spring 114. The second sleeve 108 has the second inner diameter D2*a*. The second inner diameter D2*a* is larger than the first outer diameter D1*b* of the first sleeve 116 to make the second sleeve 108 movably jacket the first sleeve 106. The switch unit 112 is adjacent to the second sleeve 108 and has a resilient arm 118 and a triggering pad 120 made of metal material. The resilient arm 118 and the triggering pad 120 are opposite to each other and are coupled to a circuit board (not shown in the figures) of the button switch 100 respectively. The second sleeve 108 has a protruding portion 122 expanding in a radial direction. The spring 114 has a first end portion 124, a second end portion 126, and a middle section 128. The middle section 128 is located between the first end portion 124 and the second end portion 126. In FIG. 5, when the key cap 102 is located at the non-pressed position, which means the restoration assembly 110 and the spring 114 are in a stretched state, the first end portion 124 is disposed through the first sleeve 116, the second end portion 126 and the middle section 128 are disposed through the second sleeve 108, and the middle outer diameter DS3 of the middle section 128 is larger than the first inner diameter D1*a* of the first sleeve 116.

Via the aforesaid designs, when the second sleeve 108 is located at the non-pressed position as shown in FIG. 5, the resilient arm 118 abuts against the protruding portion 122 of the second sleeve 108 to cause outward deformation of the resilient arm 118, so as to be separate from the triggering pad 120. When the second sleeve 108 is pressed to the pressed position as shown in FIG. 6 with downward movement of the key cap 102, which means the restoration assembly 110 and the spring 114 are in the compressed state, the resilient arm 118 is misaligned with the protruding portion 122 to abut against the triggering pad 120 for transmitting a corresponding input signal to the circuit board of the button switch 100, so that the button switch 100 can perform a corresponding input function. On the other hand, when the key cap 102 is released, the spring 114 drives the second sleeve 108 to move upward to the non-pressed position as shown in FIG. 5, which means the restoration assembly 110 and the spring 114 are back to the stretched state, so as to generate the automatic returning effect.

In addition, during the process of the key cap 102 being pressed from the non-pressed position as shown in FIG. 5 to compress the spring 114, which means the restoration assembly 110 and the spring 114 are in the compressed state, the middle section 128 interferes with the first sleeve 116 and is squeezed downward by the pressing force since the middle outer diameter DS3 is larger than the first inner diameter D1*a*, so as to shrink the middle section 26 and reduce the middle outer diameter DS3. Accordingly, the middle section 26 can slide into the first sleeve 116 through an end edge of the open end of the first sleeve 116 and abut against an inner wall 130 of the first sleeve 116 laterally to produce a tactile feedback and/or sound, and then the second end portion 126 of the spring 114 can enter the first sleeve 116 partially (as shown in FIG. 6). When the key cap 102 is pressed to the pressed position as shown in FIG. 6, which means the restoration assembly 110 and the spring 114 are about to return to the stretched state, a tactile feedback and/or sound can be produced again. The principle for producing the aforesaid tactile feedbacks and sounds is similar to the related description mentioned in the aforesaid embodiments. As for the related description for other designs of the button switch 100 (e.g. the middle outer diameter design, the structural interference design, etc.), it could be reasoned by analogy according to the aforesaid embodiments and omitted herein.

Figure 7:
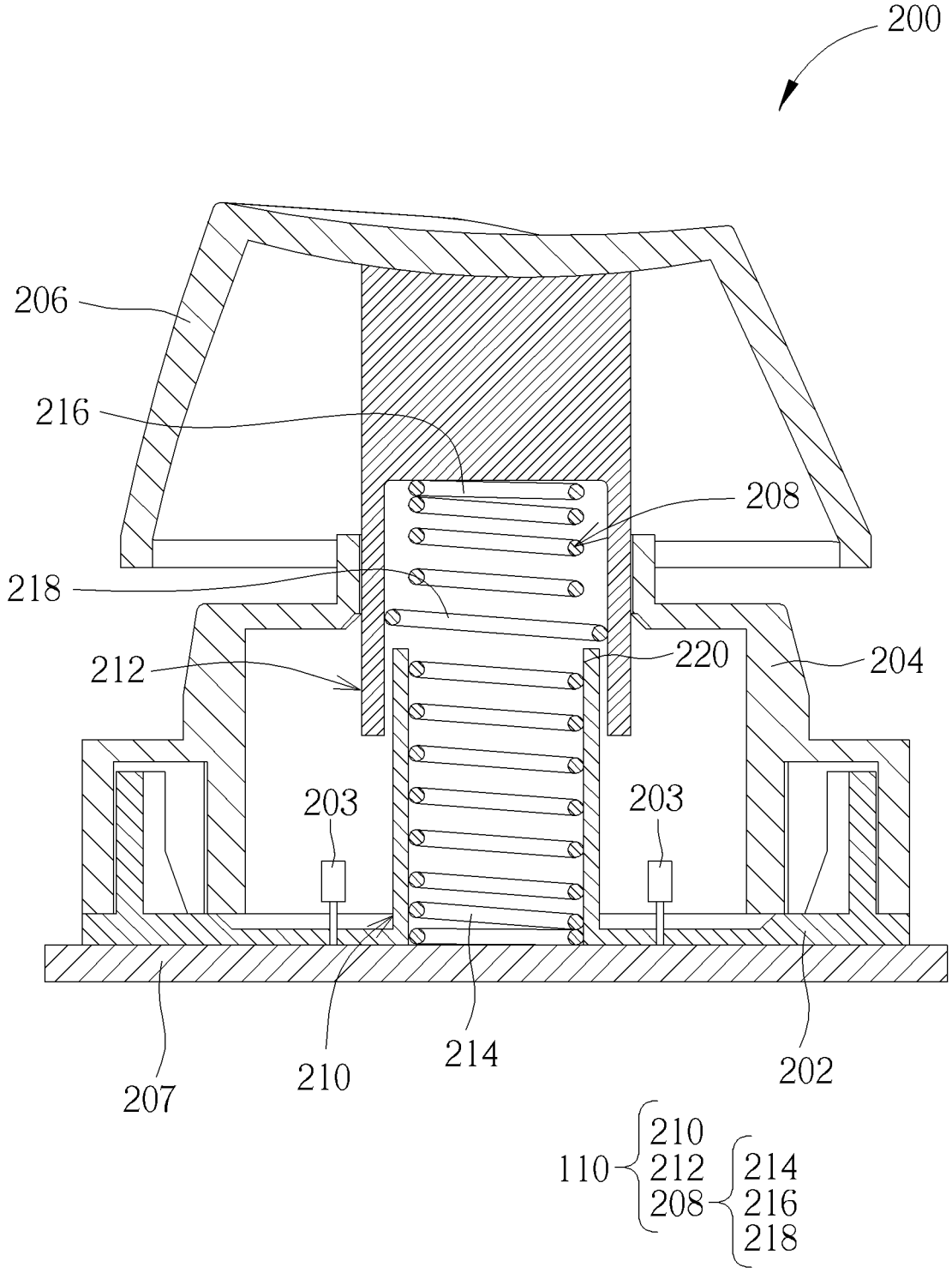
FIG. 7 is a cross-sectional diagram of a button switch according to another embodiment of the present invention.

In practical application, the present invention could be applied to the crater-shaped keyswitch design. For example, please refer to FIG. 7, which is a cross-sectional diagram of a button switch 200 according to another embodiment of the present invention. As shown in FIG. 7, the button switch 200 includes the restoration assembly 110, a base 202, a cover 204, a key cap 206, and a circuit board 207. The restoration assembly 110 includes a spring 208, a first sleeve 210, and a second sleeve 212.

As shown in FIG. 7 showing a keyboard having a plurality of button switches 200, the covers 204 of the button switches 200 are connected integrally to each other but the key caps 206 are independent from each other. In other words, a neighbor button switch at least includes a neighbor cover, a neighbor base, a first neighbor sleeve and a second neighbor sleeve. The cover 204 is connected to the neighbor cover integrally, the base 202 is connected to the neighbor base integrally, the first sleeve 210 is connected to the first neighbor sleeve integrally through the base 202 and the neighbor base, and the second sleeve 212 is connected to the second neighbor sleeve integrally through the cover 204 and the neighbor cover.

On the other hand, as shown in FIGS. 5-6 showing a keyboard having a plurality of button switches 100, the covers 106 and the bases 104 of the button switches 100 are independent from each other corresponding to the key caps 102. That is, the button switches 100 on the keyboard as shown in FIGS. 5-6 are independent from each other and are coupled to and fixed on a circuit board respectively.

The first sleeve 210 of the restoration assembly 110 protrudes from the base 202, and the cover 204 adopts a crater-shaped structural design and is disposed on the base 202 for containing the spring 208 cooperatively with the base 202. The second sleeve 212 of the restoration assembly 110 extends from the key cap 206 toward the base 202. The second sleeve 212 is movably disposed through the cover 204. An inner diameter of the second sleeve 212 is larger than an outer diameter of the first sleeve 210, so that the second sleeve 212 can movably jacket the first sleeve 210. The spring 208 has a first end portion 214, a second end portion 216 and a middle section 218 having a larger middle outer diameter. The first end portion 214 is disposed through the first sleeve 210 (a bottom end of the spring 208 can abut against the circuit board 207 or a closed bottom surface of the first sleeve 210). The second end portion 216 and the middle section 218 are disposed through the second sleeve 212. The middle outer diameter of the middle section 218 is larger than the inner diameter of the first sleeve 210. In the embodiments as shown in FIGS. 5-7, the second sleeves 108/212 have closed ends adjacent to the second end portions 126/216 of the springs 114/208 and inner walls, and the second end portions 126/216 can directly abut against the closed ends of the second sleeves 108/212. The triggering design of the button switch 200 is not limited. For example, a pair of light transceivers 203 could be disposed on the base 202, and a light blocking sheet (not shown in the figure) could extend from the second sleeve 212. In such a manner, when the key cap 206 moves to the pressed position, which means the restoration assembly 110 and the spring 208 are in the compressed state, the light blocking sheet can block the light path between the light transceivers 203 to change the intensity of light signals of the light transceivers for triggering the button switch 200. In another embodiment, the present invention could adopt the design that the second sleeve 212 is directly utilized to block light for triggering the button switch 200 without the light blocking sheet, meaning that the light path between the light transceivers 203 intersects a moving path of the second sleeve 212. In another embodiment, the present invention could adopt the triggering design that the switch unit 112 is utilized to trigger the button switch 100 as shown in FIGS. 5-6 for triggering the button switch 200 when the key cap 206 is about to reach the pressed position, which means the restoration assembly 110 and the spring 208 are about to return to the stretched state.

Via the aforesaid designs, during the process of the key cap 206 being pressed from the non-pressed position as shown in FIG. 7 to compress the restoration assembly 110 and the spring 208, the middle section 218 interferes with the first sleeve 210 and is squeezed downward by the pressing force since the middle outer diameter of the middle section 218 is larger than the inner diameter of the first sleeve 210, so as to shrink the middle section 218 and reduce the middle outer diameter. Accordingly, the middle section 218 of the spring 208 can slide into the first sleeve 210 through an end edge of the open end of the first sleeve 210 and laterally abut against an inner wall 220 of the first sleeve 210 to produce a tactile feedback and/or sound, and then the second end portion 216 of the spring 208 can enter the first sleeve 210 partially or completely. When the key cap 102 is pressed to the pressed position, which means the restoration assembly 110 and the spring 114 are about to return to the stretched state, a tactile feedback and/or sound can be produced again. The principle for producing the aforesaid tactile feedbacks and sounds is similar to the related description mentioned in the aforesaid embodiments. As for the related description for other designs of the button switch 200 (e.g. the middle outer diameter design, the structural interference design, etc.), it could be reasoned by analogy according to the aforesaid embodiments and omitted herein. Moreover, the design that the stepped structure 36 has the inner diameter increasing gradually from up to down as shown in FIG. 4 can be also applied to the first sleeve 210 in FIG. 7, so that the button switch 200 can produce an additional tactile feedback and friction/collision sounds.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A button switch comprising:

a key cap;

a base disposed opposite to the key cap; and a restoration assembly disposed between the key cap and the base, the restoration assembly comprising:

a first sleeve having a first inner diameter and a first outer diameter;

a second sleeve having a second outer diameter larger than the first outer diameter of the first sleeve to make the second sleeve movably jacket outside the first sleeve, the jacketed first and second sleeves being disposed between the key cap and the base; and a spring disposed between the first sleeve and the second sleeve, the spring having a first end portion, a second end portion and a middle section, a middle outer diameter of the middle section being larger than the first inner diameter of the first sleeve and larger than an outer diameter of the second end portion, and the second end portion being located between the key cap and the middle section;

wherein when the key cap is located at a non-pressed position, the first end portion is disposed through the first sleeve, and the second end portion and the middle section are disposed through the second sleeve;

during the spring being compressed along with the key cap being pressed downward, the middle section is squeezed to shrink and slide into the first sleeve through an end edge of the first sleeve, thereby producing a tactile feedback and/or a first sound;

when the spring is released from a pressed position along with the key cap, the spring extends to move the middle section from the first sleeve back into the second sleeve.

2. The button switch of claim 1, wherein a slanted surface is formed on an end edge of an open end of the first sleeve to guide the middle section of the spring to slide into the first sleeve smoothly.

3. The button switch of claim 1, wherein the outer diameter of the second end portion of the spring is less than the first inner diameter of the first sleeve.

4. The button switch of claim 1, wherein an open end of the first sleeve further comprises a stepped structure having an inner diameter increasing gradually from up to down for temporarily reducing the middle outer diameter of the spring during the key cap being pressed.

5. The button switch of claim 4, wherein when the middle section of the spring slides downward and completely crosses the stepped structure, the middle section returns to its original state to expand the middle outer diameter outward for colliding with an inner wall of the first sleeve to make a sound.

6. The button switch of claim 1, wherein when the spring is released from the pressed position along with the key cap, the middle section slides upward and then elastically returns to its original state to expand the middle outer diameter outward for colliding with an inner wall of the second sleeve to make a sound.

7. The button switch of claim 1, wherein an end of the first sleeve jacketed by the second sleeve has a limiting portion surrounding an outer wall of the first sleeve, and an end of the second sleeve jacketing the first sleeve has a protruding edge formed along an inner wall of the second sleeve correspondingly for interfering with the limiting portion.

8. The button switch of claim 1, wherein a terminal end of the first sleeve only abuts against but is not connected to the base, the second sleeve is directly connected to the key cap, and the restoration assembly is detachable from the base together with the key cap.

9. The button switch of claim 1 further comprising:

a lifting mechanism movably connected to the key cap and the base to make the key cap movable upward and downward relative to the base;

wherein the lifting mechanism is selected from a scissor support structure or a butterfly support structure.

10. The button switch of claim 1, wherein the button switch further comprises a cover disposed under the key cap and assembled on the base, the first sleeve protrudes from the base toward the cover, the cover and the base cooperatively contain the restoration assembly, and the second sleeve movably passes through the cover.

11. The button switch of claim 10, wherein the second sleeve has a connection portion extending upward to be connected to the key cap, and the second sleeve has a rod portion extending downward to be inserted into the second end portion of the spring.

12. The button switch of claim 1, wherein the first sleeve protrudes from the base upward, and the second sleeve extends from the key cap toward the base.

13. The button switch of claim 12, wherein the button switch further comprises a cover disposed under the key cap and assembled on the base, the button switch is adjacent to a neighbor button switch, the neighbor button switch comprises a neighbor cover, a neighbor base, a first neighbor sleeve and a second neighbor sleeve, the first sleeve is integrally connected to the first neighbor sleeve through the base and the neighbor base, and the second sleeve is integrally connected to the second neighbor sleeve through the cover and the neighbor cover.

14. A restoration assembly for returning a button switch after the button switch is pressed, the restoration assembly comprising:

a first sleeve having a first inner diameter and a first outer diameter;

a second sleeve having a second outer diameter larger than the first outer diameter of the first sleeve to make the second sleeve movably jacket outside the first sleeve; and a spring disposed between the first sleeve and the second sleeve, the spring having a first end portion, a second end portion and a middle section, a middle outer diameter of the middle section being larger than the first inner diameter of the first sleeve and larger than an outer diameter of the second end portion, and the middle section being located between the first end portion and the second end portion;

wherein when the first sleeve and the second sleeve are in a stretched state, the first end portion is disposed through the first sleeve, and the second end portion and the middle section are disposed through the second sleeve;

when the first sleeve and the second sleeve are in a compressed state, the middle section is squeezed to shrink and slide into the first sleeve through an end edge of the first sleeve, thereby producing a tactile feedback and/or a sound;

when the first sleeve and the second sleeve are released from the compressed state, the spring extends to move the middle section from the first sleeve back into the second sleeve.

15. The restoration assembly of claim 14, wherein an open end of the first sleeve further comprises a stepped structure having an inner diameter increasing gradually from up to down for temporarily reducing the middle outer diameter of the spring during the spring being pressed from the stretched state to the compressed state.

16. The restoration assembly of claim 15, wherein when the spring is released from the compressed state, the middle section of the spring slides upward and completely crosses the stepped structure, the middle section returns to its original state to expand the middle outer diameter outward for colliding with an inner wall of the second sleeve to make a sound.

17. The restoration assembly of claim 15, wherein when the middle section of the spring slides downward and completely crosses the stepped structure, the middle section returns to its original state to expand the middle outer diameter outward for colliding with an inner wall of the first sleeve to make a sound.

18. The restoration assembly of claim 14, wherein a terminal end of the first sleeve only abuts against but is not connected to a base of the button switch, the second sleeve is directly connected to a key cap of the button switch, and the restoration assembly is detachable from the base together with the key cap.

* * * * *